US007380357B2

(12) United States Patent
Jones et al.

(10) Patent No.: US 7,380,357 B2
(45) Date of Patent: Jun. 3, 2008

(54) PROMOTIONAL BADGE HOLDING APPARATUS

(75) Inventors: Robert A. Jones, Raleigh, NC (US); Scott A. Kroggel, Garner, NC (US)

(73) Assignee: Adstracts, Inc., Raleigh, NC (US)

( * ) Notice: Subject to any disclaimer, the term of this patent is extended or adjusted under 35 U.S.C. 154(b) by 243 days.

(21) Appl. No.: 11/003,630

(22) Filed: Dec. 3, 2004

(65) Prior Publication Data

US 2006/0117616 A1 Jun. 8, 2006

(51) Int. Cl.
*A44C 3/00* (2006.01)

(52) U.S. Cl. ..... 40/1.5; 40/586

(58) Field of Classification Search ..... 40/1.5, 40/1.6, 586, 661.04; 24/3.11, 3.12, 3.13; D3/215, 227

See application file for complete search history.

(56) References Cited

U.S. PATENT DOCUMENTS 812,150 A * 2/1906 McLean ..... 242/379
1,234,559 A * 7/1917 Nickum ..... 40/1.5
1,443,194 A * 1/1923 Pichler ..... 242/376
2,732,146 A * 1/1956 Napolitani ..... 242/581
3,257,696 A * 6/1966 Miller et al. ..... 24/116 A
3,277,593 A * 10/1966 Jarrett ..... 40/661.04
3,583,085 A * 6/1971 Klitzner ..... 40/1.5
3,968,670 A * 7/1976 Quenot ..... 70/456 R
D253,676 S * 12/1979 Mathieson ..... D3/207
4,646,987 A * 3/1987 Peterson ..... 242/378.3
5,079,851 A * 1/1992 Sill ..... 33/760
5,815,873 A * 10/1998 Jones ..... 15/106
5,833,165 A * 11/1998 Paugh ..... 242/379.2
5,864,925 A * 2/1999 McGee ..... 24/3.11
5,954,288 A * 9/1999 Shih ..... 242/380
6,073,875 A * 6/2000 Paugh ..... 242/379.2
6,226,905 B1 * 5/2001 Osuna ..... 40/1.6
6,290,158 B1 * 9/2001 Huang ..... 242/379
6,364,237 B1 * 4/2002 Kagel ..... 242/379
6,419,175 B1 * 7/2002 Rankin, VI ..... 242/373
D465,645 S * 11/2002 Lombardo et al. ..... D3/215
D466,438 S * 12/2002 Buettell ..... D11/200
D471,005 S * 3/2003 Hastings ..... D3/215
D474,595 S * 5/2003 Cuff ..... D3/247
D485,981 S * 2/2004 Romero ..... D3/215
D498,358 S * 11/2004 Wolff ..... D3/215
D504,306 S * 4/2005 Chisolm ..... D8/356
6,929,209 B2 * 8/2005 Baumgarten ..... 242/377
D514,311 S * 2/2006 Cetera ..... D3/215

(Continued)

*Primary Examiner*—William L. Miller
(74) *Attorney, Agent, or Firm*—Myers Bigel Sibley & Sajovec, P.A.

(57) ABSTRACT

A promotional apparatus for use in holding badges and other forms of identification includes a first housing, a second housing, an extendable and retractable cord that tethers the first and second housings together, and a badge holder secured to the second housing. The cord is normally retracted within one of the first and second housings such that the first and second housings are in adjacent relationship with each other when the cord is normally retracted. The badge holder and second housing can be retractably extended away from the first housing by a user. When extended away from the first housing, the second housing is free to rotate about an axis. The first housing includes an attachment device that releasably secures the first housing to a user's clothing and allows a user to extend the badge holder away from the first housing without dislodging the first housing from the user's clothing.

6 Claims, 4 Drawing Sheets

U.S. PATENT DOCUMENTS 7,007,882 B2 * 3/2006 Raia et al. ..... 242/379
7,228,651 B1 * 6/2007 Saari ..... 40/1.5
2001/0037542 A1 * 11/2001 Elliott ..... 24/3.11
2002/0104914 A1 * 8/2002 Rankin, VI ..... 242/373
2003/0093931 A1 * 5/2003 Cuff ..... 40/1.6
2004/0089759 A1 * 5/2004 Genuise ..... 242/379
2004/0188557 A1 * 9/2004 Raia et al. ..... 242/379
2005/0011981 A1 * 1/2005 Baumgarten ..... 242/377

* cited by examiner

PROMOTIONAL BADGE HOLDING APPARATUS

FIELD OF THE INVENTION

The present invention relates generally to product and service promotion and, more particularly, to the promotion of healthcare-related products and services.

BACKGROUND OF THE INVENTION

The use of promotional items has proliferated in today's increasingly competitive marketplace, where companies are constantly seeking new and more effective ways to market their products and services. In the healthcare industry, physicians and other healthcare providers often receive promotional articles from vendors of healthcare-related products, such as pharmaceutical products. These promotional articles often include "everyday" items, such as writing pads, calendars, and pens, and typically have promotional information (indicia) printed thereon. For example, pharmaceutical companies often provide physicians with writing pens and pads having the name of a particular pharmaceutical product printed thereon with the hopes that the pens and pads, when used, will help remind physicians to prescribe the pharmaceutical product.

Unfortunately, often because of lack of distinctiveness, many promotional articles provided to healthcare providers become "lost-in-the-shuffle" with other promotional articles. Thus, there is a need for distinctive, more effective promotional products directed to physicians and other healthcare providers.

SUMMARY OF THE INVENTION

In view of the above discussion, a promotional apparatus for use in holding badges and other forms of identification, according to embodiments of the present invention, includes a first housing, a second housing, an extendable and retractable cord that tethers the first and second housings together, and a badge holder secured to the second housing. The cord is normally retracted within one of the first and second housings such that the first and second housings are in adjacent relationship with each other when the cord is normally retracted. The badge holder and second housing can be retractably extended away from the first housing by a user. Upon release by the user, the cord returns to its normally retracted configuration. When extended away from the first housing, the second housing is free to rotate about an axis.

According to embodiments of the present invention, the first housing includes an attachment device, such as a clip, that is configured to releasably secure the first housing to the clothing of a user and to allow a user to extend the badge holder and second housing away from the first housing without dislodging the first housing from the user's clothing.

According to embodiments of the present invention, the first and/or second housings may include promotional indicia thereon.

Embodiments of the present invention can serve as promotional devices directed to the marketing of various pharmaceuticals and healthcare products and services, as well as other products and services of various industries, without limitation. For example, promotional indicia directed to weight loss products and services may be displayed on embodiments of the present invention.

BRIEF DESCRIPTION OF THE DRAWINGS

The accompanying drawings, which form a part of the specification, illustrate key embodiments of the present invention. The drawings and description together serve to fully explain the invention.

FIGS. 1-2 are perspective views of a badge holding apparatus, according to embodiments of the present invention, wherein FIG. 1 illustrates the first and second housings in adjacent, docking relationship, and wherein FIG. 2 illustrates the badge holder and second housing extended away from the first housing.

DETAILED DESCRIPTION OF THE INVENTION

Figure 1:
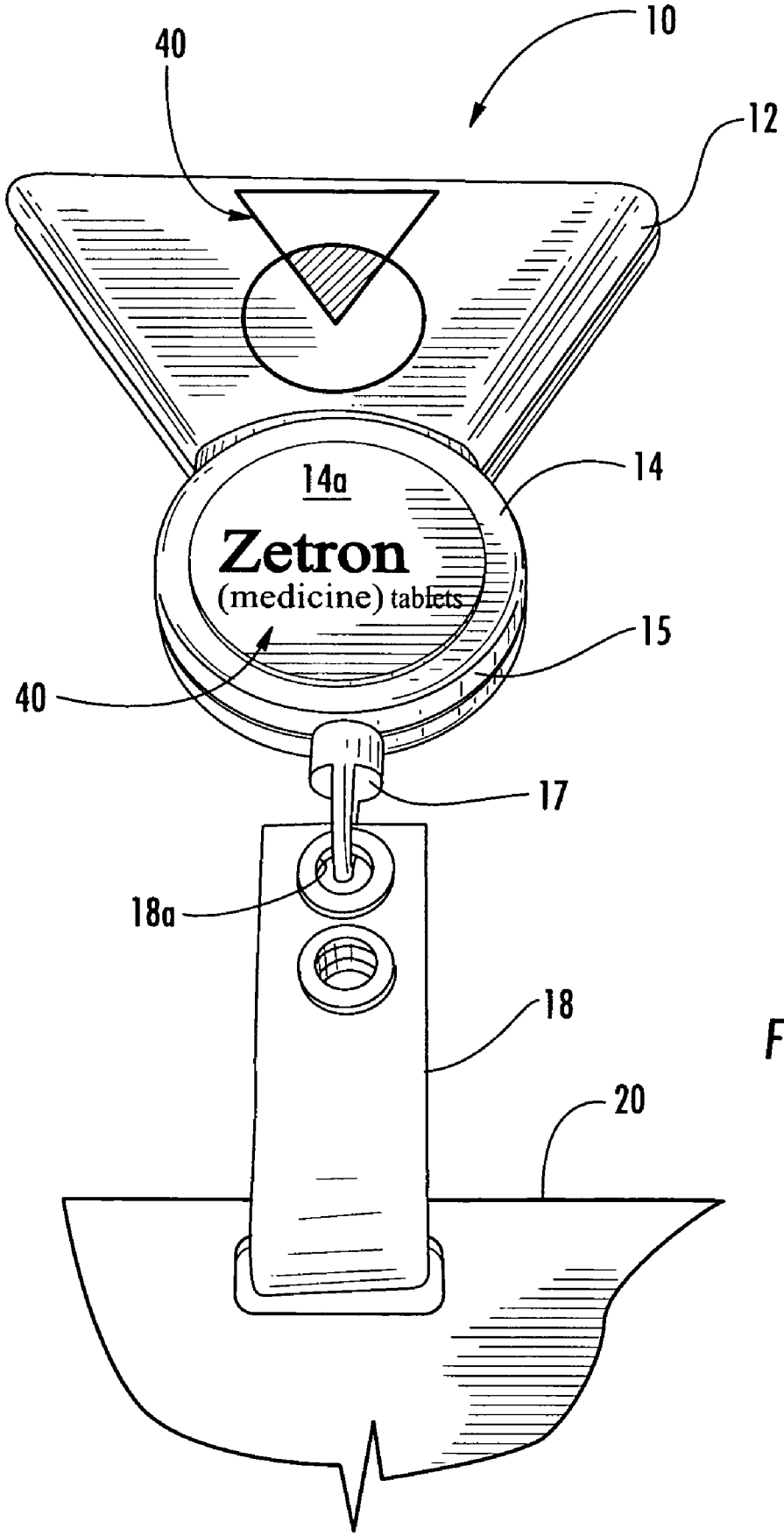

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items.

In the drawings, the thickness of lines, and elements may be exaggerated for clarity. It will be understood that when an element is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "vertical", "horizontal" and the like are used herein for the purpose of explanation only.

Referring now to FIGS. 1-4, a badge holding apparatus 10, according to embodiments of the present invention, includes a first housing 12, a second housing 14, an extendable and retractable cord 16 that tethers the first and second housings 12, 14 together, and a badge holder 18 secured to the second housing 14. The badge holder 18 is configured to hold an identification badge 20 or other similar article for display and/or use. The illustrated badge holder 18 is rotatably secured to the second housing 14 via a swivel connection or "bob" 17 that permits the second housing 14 and badge holder 18 to rotate independent of each other. The badge holder 18 includes an aperture 18*a* through which the bob 17 is engaged to secure the badge holder 18 to the second housing 14, as illustrated.

The cord 16 is normally retracted within either the first housing 12 or the second housing 14 and is extendable when a user pulls the badge holder 18 and second housing 16 away from the first housing 12, for example, to present a badge 20 attached to the badge holder 18 for inspection, to swipe the badge 20 through a reader or other device, etc. Upon release of the badge holder 18 and second housing 14 by the user, the cord 16 automatically returns to its normally retracted configuration. According to other embodiments of the present invention, the cord 16 may be manually retracted within one of the first and second housings 12, 14.

Figure 2:
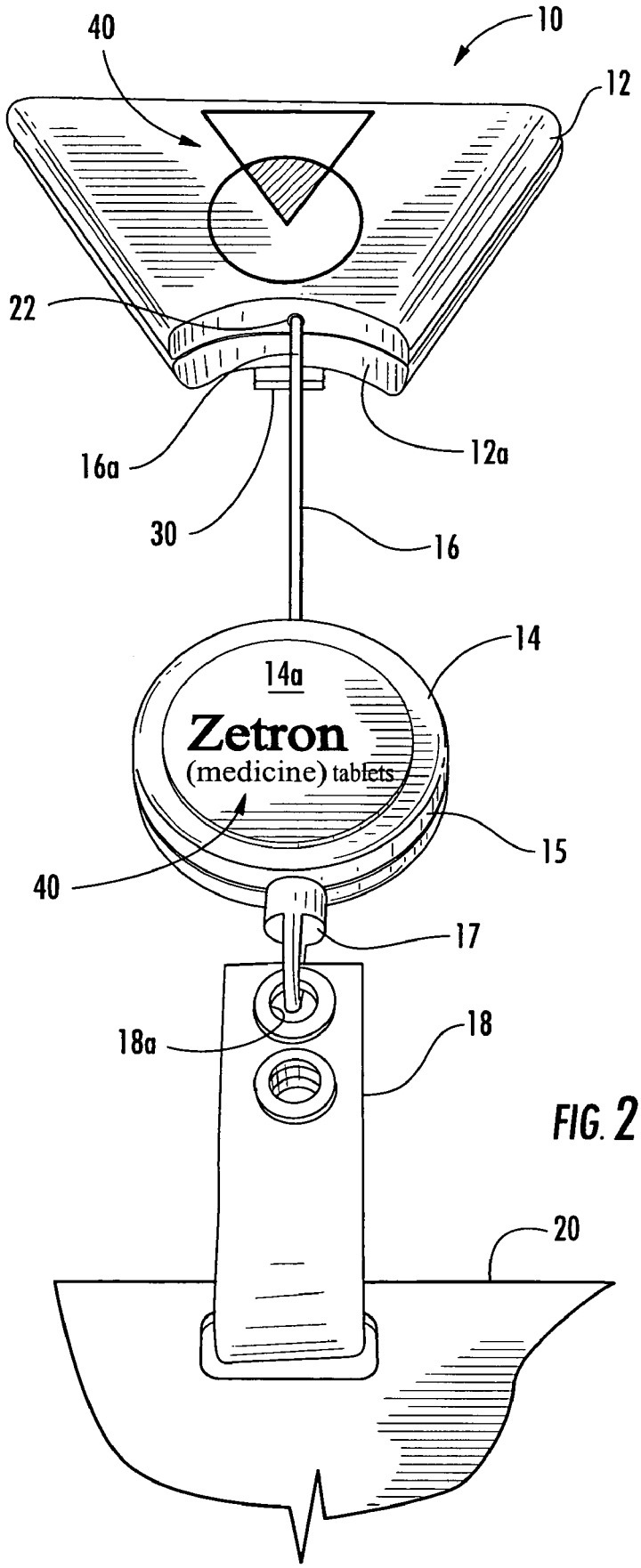
Figure 3:
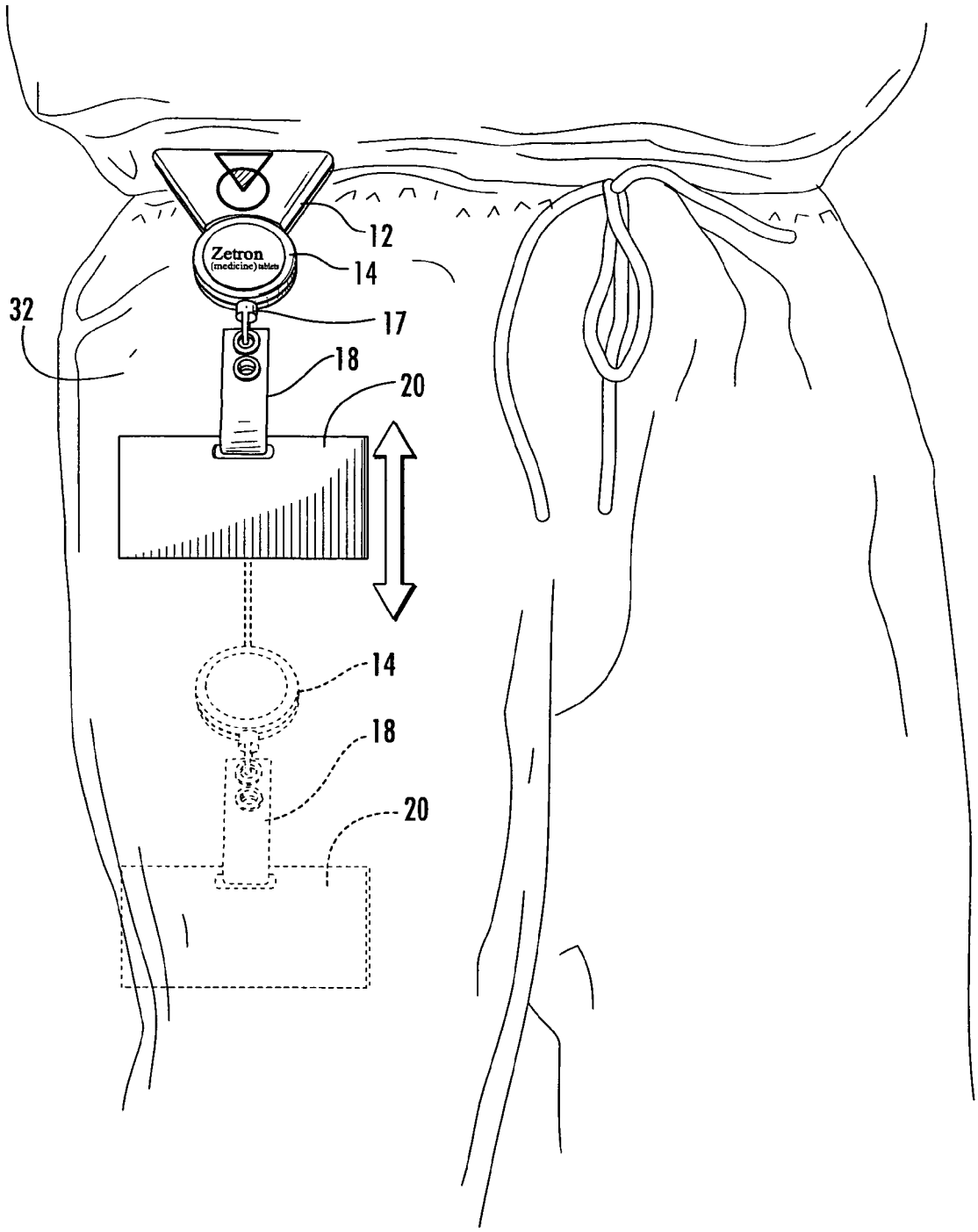
FIG. 3 illustrates the badge holding apparatus of FIG. 1 removably secured to the clothing of a user.

In the illustrated embodiment, although not illustrated for clarity reasons, the cord 16 is fully retracted (FIG. 1) within the second housing 14 and a free end 16*a* extends through an aperture (not shown) in a peripheral portion 15 of the second housing 14 and is secured to the first housing 12. As illustrated in FIG. 2, the cord free end 16*a* extends through an aperture 22 in the first housing 12 and is secured within the first housing 12. However, the cord free end 16*a* may be secured to the second housing in various ways. In addition, according to other embodiments of the present invention, the cord 16 may be normally fully retracted within the first housing 12 and the cord free end 16*a* may be secured to the second housing 14.

The cord 16 may be retractably extendable from either the first or second housings 12, 14 via any of various known methodologies. For example, a wind-up spring and reel mechanism as described in U.S. Pat. No. 6,364,237, which is incorporated herein by reference in its entirety, may be utilized. The cord may be formed from various types of materials including, but not limited to, wire, chain, rope, twine, etc. The cord 16 preferably has an extended length of between about twelve inches (12 in.) and about thirty-six inches (36 in.), however other lengths may be utilized as long as the cord 16 has a length sufficient to allow a user to present a badge attached to the badge holder 18 for inspection, swipe a card attached to the badge holder 18, etc.

The illustrated first housing 12 has a generally triangular shape with an arcuate end portion 12*a* at one of the "points" of the triangle. The second housing 14 has a generally circular shape. However, the first and second housings 12, 14 may have any shape desired including, but not limited to, an elliptical shape (e.g., oval, etc.) or polygonal shape (e.g., triangular, square, rectangular, hexagonal, and the like). In the illustrated embodiment, the first housing arcuate end portion 12*a* has a similar radius of curvature to that of the second housing periphery 15. As such, the arcuate end portion 12*a* is configured to receive the second housing 14 therein in docking relationship when the cord 16 is fully retracted, as illustrated in FIG. 1.

In the illustrated embodiment, the first housing 12 includes promotional indicia 40 thereon. In addition, the second housing 14 includes opposite display panels 14*a*, 15*b* having promotional indicia 40 thereon. Various types of promotional indicia including, but not limited to, lettering, designs, characters, logos and other symbols, may be utilized in accordance with embodiments of the present invention. The term "lettering" as used herein includes, but is not limited to, alphabetical characters and alphanumeric characters. Moreover, promotional indicia may be utilized virtually anywhere on the first and second housings 12, 14. Embodiments of the present invention are not limited to the illustrated location and configuration of promotional indicia 40.

In the illustrated embodiment, the first housing 12 includes a clip 30 that is configured to releasably secure the first housing 12 to the clothing 32 (e.g., shirt pocket, pants waistband, lapel, etc.) of a user (FIG. 3) and to allow a user to extend the badge holder 18 and second housing 14 away from the first housing 12 without dislodging the first housing 12 from the user's clothing 32. Various types of attachment devices may be utilized to secure the apparatus 10 to a user's clothing, person, or to another article, without limitation. Exemplary attachment devices, in addition to the clip 30, include hook and loop fastening systems, safety pins, etc. Moreover, the attachment device may be a loop of material configured to have a belt inserted therethrough.

Figure 4:
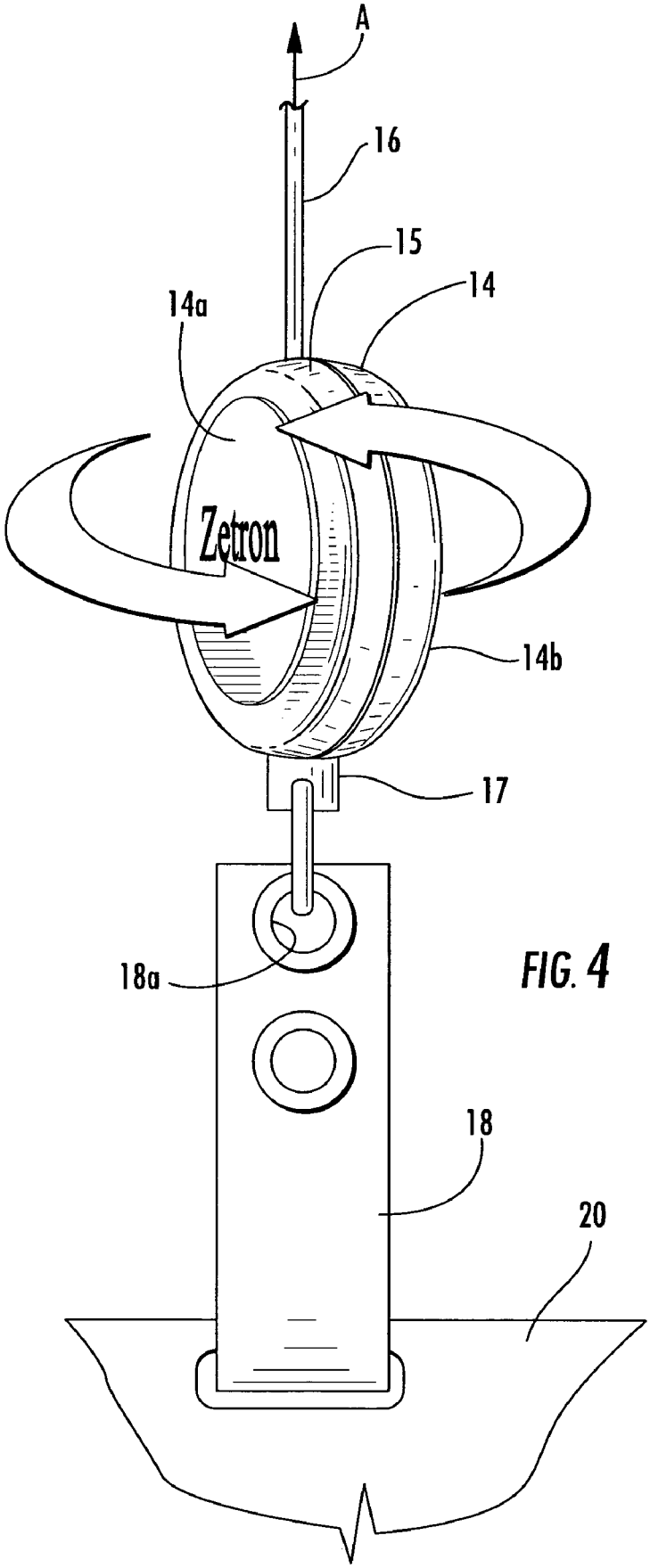
FIG. 4 is a perspective view of the badge holding apparatus of FIGS. 1-2 that illustrates rotation of the second housing.

As illustrated in FIG. 4, the second housing 14 is free to rotate about an axis A when extended away from the first housing 12. When the first and second housings 12, 14 are in docking relationship (FIG. 1), the second housing 14 is prohibited from spinning about axis A via the configuration of the first housing arcuate end portion 12*a*. For example, tabs or other structural members may be provided that prevent rotational movement of the second housing 14 when docked with the first housing 12. Alternatively, the arcuate end portion 12*a* may include a recessed portion that receives the second housing periphery 15 in snug relationship therewith.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A badge holding apparatus, comprising:

a first housing;

a second housing having opposite display panels with promotional indicia thereon;

an extendable and retractable cord that tethers the first and second housings together, wherein the cord is normally retracted within one of the first and second housings, wherein the second housing is free to rotate about an axis when extended away from the first housing, wherein the first and second housings are in adjacent, docking relationship with each other when the cord is normally retracted such that the second housing is prevented from rotating when in docking relationship with the first housing; and a badge holder rotatably secured to the second housing via a bob, wherein the badge holder and bob are not extendable from the second housing, wherein the badge holder and second housing can be retractably extended away together from the first housing by a user, and wherein the badge holder and bob are free to rotate 360° about an axis both when the second housing is extended away from the first housing and when the second housing is in docking relationship with the first housing.

2. The apparatus of claim 1, wherein the cord is normally retracted within the first housing.

3. The apparatus of claim 1, wherein the cord is normally retracted within the second housing.

4. The apparatus of claim 1, wherein the cord has an extended length of between about 12 inches and about 36 inches.

5. The apparatus of claim 1, wherein the first housing comprises an attachment device that is configured to releasably secure the first housing to the clothing of a user and to allow a user to extend the badge holder and second housing away from the first housing without dislodging the first housing from the user's clothing.

6. The apparatus of claim 5, wherein the attachment device comprises a clip.

* * * * *